US010024136B2

(12) United States Patent
Watson et al.

(10) Patent No.: US 10,024,136 B2
(45) Date of Patent: Jul. 17, 2018

(54) SYSTEMS AND METHODS FOR FLUID COMMUNICATION WITH AN EARTH FORMATION THROUGH CEMENT

(71) Applicant: THRU TUBING SOLUTIONS, INC., Oklahoma City, OK (US)

(72) Inventors: Brock W. Watson, Sadler, TX (US); Roger L. Schultz, Newcastle, OK (US); Andrew M. Ferguson, Moore, OK (US)

(73) Assignee: Thru Tubing Solutions, Inc., Oklahoma City, OK (US)

( * ) Notice: Subject to any disclaimer, the term of this patent is extended or adjusted under 35 U.S.C. 154(b) by 45 days.

(21) Appl. No.: 15/059,096

(22) Filed: Mar. 2, 2016

(65) Prior Publication Data

US 2016/0326832 A1 Nov. 10, 2016

Related U.S. Application Data

(62) Division of application No. 14/705,688, filed on May 6, 2015, now Pat. No. 9,309,746.

(51) Int. Cl.

| | |
|---|---|
| ***E21B 33/13*** | (2006.01) |
| ***E21B 33/14*** | (2006.01) |
| ***C09K 8/467*** | (2006.01) |
| ***C09K 8/42*** | (2006.01) |
| ***E21B 27/02*** | (2006.01) |

(Continued)

(52) U.S. Cl.

CPC ..... *E21B 33/14* (2013.01); *E21B 27/02* (2013.01); *E21B 34/10* (2013.01); *E21B 43/14* (2013.01); *E21B 43/26* (2013.01); *E21B 2034/007* (2013.01)

(58) Field of Classification Search

CPC ..... E21B 33/14; E21B 33/13; C09K 8/467; C09K 8/42

See application file for complete search history.

(56) References Cited

U.S. PATENT DOCUMENTS 7,303,014 B2 12/2007 Reddy et al.
7,798,226 B2 9/2010 Themig (Continued)

OTHER PUBLICATIONS

International Search Report with Written Opinion dated Aug. 18, 2016 for PCT Patent Application No. PCT/US2016/030107, 20 pages.

(Continued)

*Primary Examiner* — Catherine Loikith
(74) *Attorney, Agent, or Firm* — Smith IP Services, P.C.

(57) ABSTRACT

A well system can include a well tool with a retarder chemical. The retarder chemical is released from the well tool into an annulus and retards setting of cement therein. A method of retarding setting of cement at a location in an annulus can include releasing a retarder chemical from a well tool connected in a casing string, after the cement is placed in the annulus. A well tool can include a valve that controls fluid communication via a port between an exterior of the tool and a flow passage extending through the tool, an annular recess, and a dispersible annular exterior component received in the recess. Another well tool can include a valve that controls fluid communication between an exterior of the tool and a flow passage extending through the well tool, an internal chamber, and a retarder chemical in the chamber.

11 Claims, 14 Drawing Sheets

(51) Int. Cl.

| | |
|---|---|
| ***E21B 43/14*** | (2006.01) |
| ***E21B 43/26*** | (2006.01) |
| ***E21B 34/10*** | (2006.01) |
| *E21B 34/00* | (2006.01) |

(56) References Cited

U.S. PATENT DOCUMENTS

| | | | | |
|---|---|---|---|---|
| 8,083,849 | B2 * | 12/2011 | Lewis | G06F 3/1205 106/606 |
| 8,136,594 | B2 | 3/2012 | Streich et al. | |
| 8,162,054 | B2 | 4/2012 | Schultz et al. | |
| 8,342,244 | B2 | 1/2013 | Streich et al. | |
| 2013/0213646 | A1 | 8/2013 | Angman et al. | |
| 2015/0047828 | A1 | 2/2015 | Sherman et al. | |

OTHER PUBLICATIONS

Halliburton Energy Services, Inc.; "Retarders", catalog listing materials, dated Apr. 7, 2015, 1 page.
Office Action dated Oct. 15, 2015 for U.S. Appl. No. 14/705,688, 14 pages.

* cited by examiner

SYSTEMS AND METHODS FOR FLUID COMMUNICATION WITH AN EARTH FORMATION THROUGH CEMENT

CROSS-REFERENCE TO RELATED APPLICATION

This application is a division of prior application Ser. No. 14/705,688 filed on 6 May 2015. The entire disclosure of this prior application is incorporated herein by this reference.

BACKGROUND

This disclosure relates generally to equipment utilized and operations performed in conjunction with a subterranean well and, in one example described below, more particularly provides for fluid communication with an earth formation through cement.

It is common practice to use cement for securing a casing string in a wellbore, and for providing pressure isolation in an annulus formed between the casing string and the wellbore. In order to produce fluids from an earth formation penetrated by the wellbore into the casing string, or to inject fluids from the casing string into the formation, it is desirable to be able to provide for fluid communication through the cement in the annulus at specific locations. Therefore, it will be readily appreciated that advancements are continually needed in the art of providing fluid communication with an earth formation through cement.

DETAILED DESCRIPTION

Figure 1A:
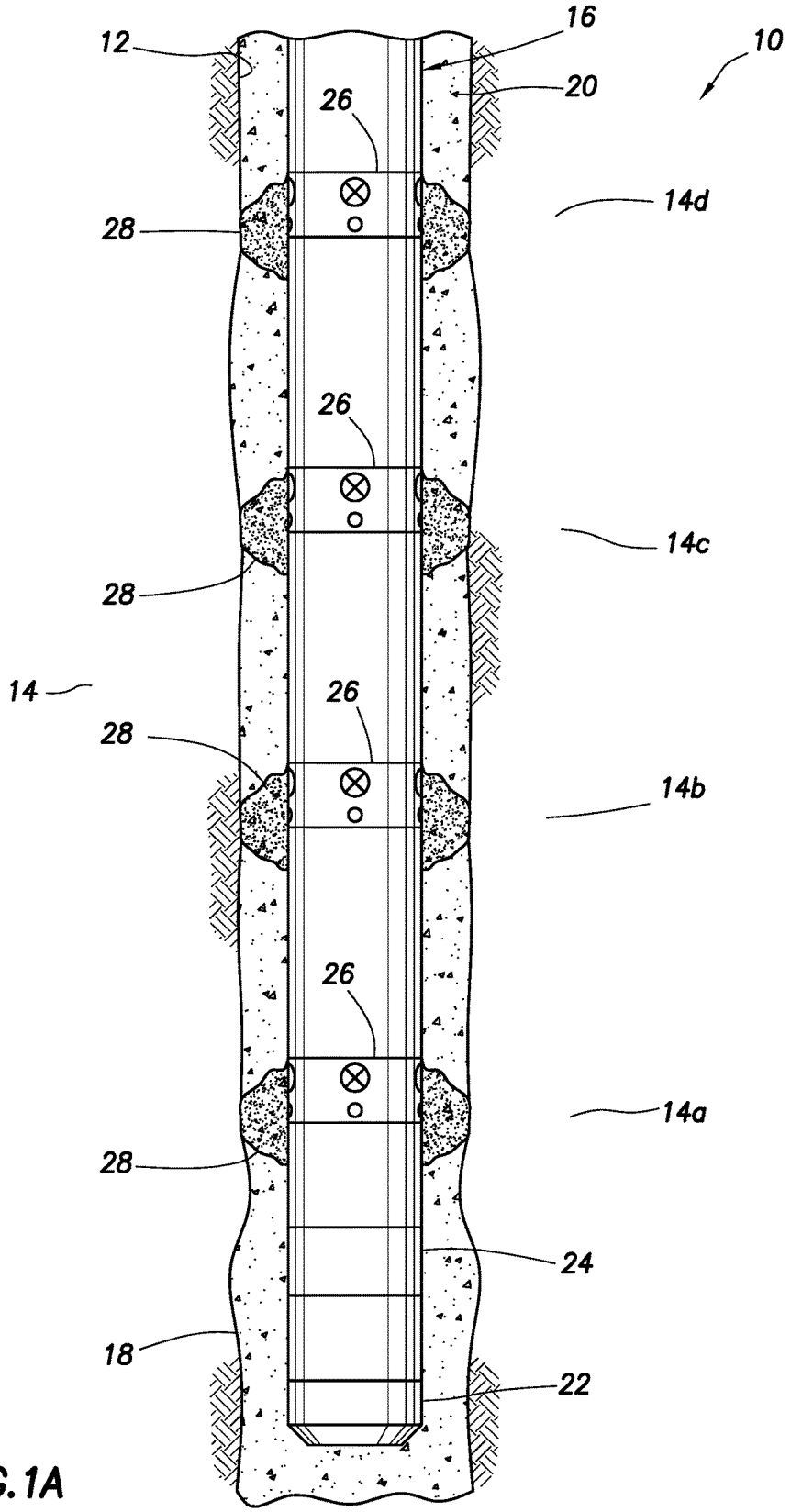
FIGS. 1A-C are representative partially cross-sectional views of an example of a well system and associated method which can embody principles of this disclosure, the well system being depicted after a retarder chemical has been released into a well annulus, after a first zone has been fractured, and after multiple zones have been fractured.
Figure 1B:
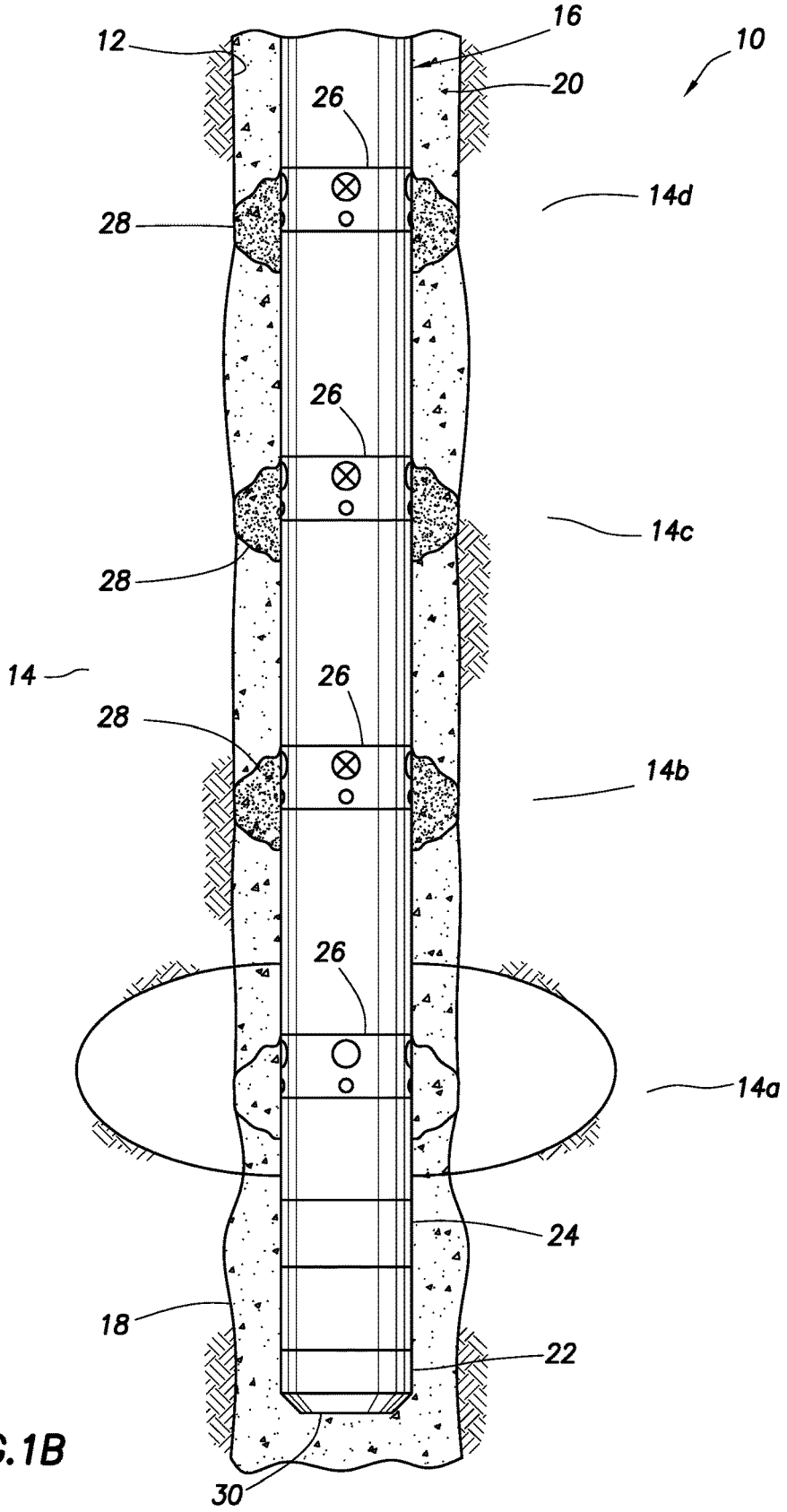
Figure 1C:
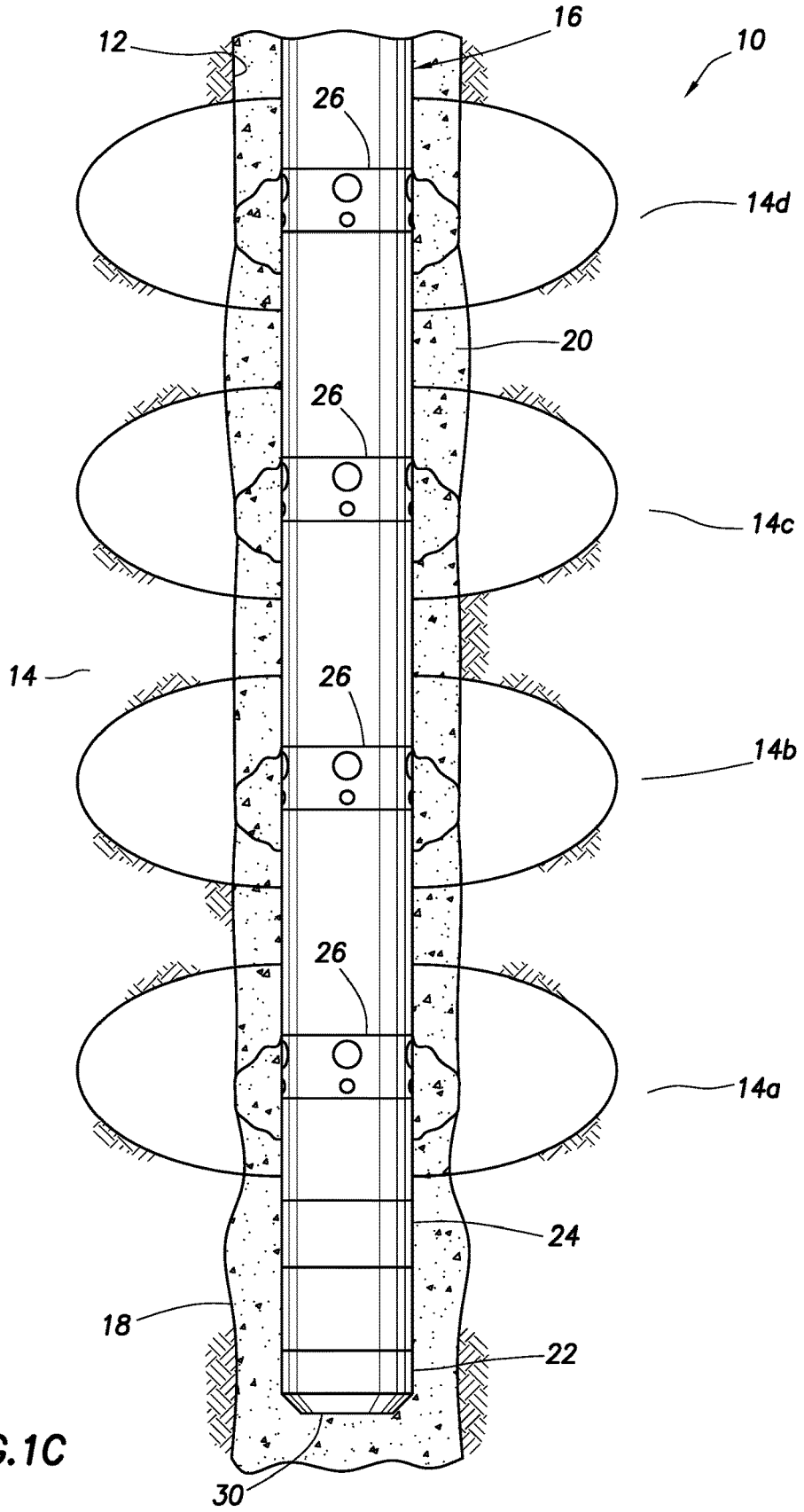

Representatively illustrated in FIGS. 1A-C is a system 10 for use with a well, and an associated method, which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

As depicted in FIGS. 1A-C, a wellbore 12 has been drilled so that it penetrates an earth formation 14. Several specific zones 14*a-d* of the formation 14 are illustrated in FIGS. 1A-C. However, it should be clearly understood that the scope of this disclosure is not limited to situations involving multiple zones of a single formation, or to any particular number of zones. Instead, the principles of this disclosure can be readily applied to situations involving multiple formations or any number of zones (including one).

In addition, although the wellbore 12 as depicted in FIGS. 1A-C is generally vertical, the principles of this disclosure can be readily applied to generally horizontal or inclined wellbores. Thus, it will be appreciated that the scope of this disclosure is not limited to any of the particular details of the wellbore 12, formation 14 and/or zones 14*a-d* as described herein or depicted in the drawings.

Referring specifically to FIG. 1A, a casing string 16 has been installed in the wellbore 12, and cement 18 has been flowed into an annulus 20 formed between the casing string and the wellbore. Eventually, the cement 18 will harden or "set" to thereby secure the casing string 16 in the wellbore 12, and to seal off the annulus 20.

To provide for such cementing of the casing string 16 in the wellbore 12, the casing string can include items of equipment known to those skilled in the art as a guide shoe or float shoe 22 and a float collar 24, for example. The use of such equipment to flow cement through casing and out into an annulus external to the casing is well known to those skilled in the art, and so will not be described further herein.

As used herein, the term "casing" is used to refer to a protective wellbore lining. Casing can be in the form of tubular products known to those skilled in the art as casing, liner and tubing, for example. Casing can be expanded or otherwise formed downhole, and can be made of a variety of materials (such as, metals and metal alloys, plastics and other polymers, etc.). Thus, the scope of this disclosure is not limited to use of any particular type of casing.

As used herein, the term "cement" is used to refer to a cementitious material that hardens downhole to secure a casing and seal off an annulus adjacent the casing. Cement hardens or sets as a result of hydration of the cement. Cement may include Portland cement, as well as a variety of other materials, for example, to vary setting time, to enhance strength, to enhance sealing capability, etc. The scope of this disclosure is not limited to use of any particular type of cement.

In the FIG. 1A example, the casing string 16 includes multiple spaced apart well tools 26. The well tools 26 serve a number of different functions, but in a general aspect, the well tools serve to permit fluid communication between an interior of the casing string 16 and each of the zones 14*a-d*. Thus, in this example, the well tools 26 are connected in the casing string 16 at positions corresponding to the respective zones 14*a-d*.

Note that it is not necessary for a single well tool to be positioned at a corresponding single zone. Instead, for example, multiple well tools could be used for a single zone. As another example, a particular zone (such as a zone that is not presently economically viable for production) may not have a corresponding well tool. Thus, the scope of this disclosure is not limited to any particular arrangement of well tools, or to any particular correspondence between well tools and zones.

In the FIG. 1A example, the well tools 26 each release a cement retarder chemical 28 into the annulus 20 after the cement 18 has been placed in the annulus, but before the cement hardens or sets. The retarder chemical 28 prevents (or at least substantially retards) hardening or setting of the cement 18 in the discrete locations in the annulus 20 external to the individual well tools 26. In this manner, fluid communication can be more readily provided between the casing string 16 and the individual zones 14*a-d* at those locations when desired.

The retarder chemical 28 can be any of those that substantially retard or entirely prevent hardening or setting of the cement 18. Suitable examples include (but are not limited to) sugar, HR™ or SCR™ series of retarders marketed by Halliburton Energy Services, Inc. of Houston, Tex., USA, lignosulfonates, and X186™ retarder marketed by Schlumberger Limited of Houston, Tex., USA. The scope of this disclosure is not limited to use of any particular retarder chemical.

After the retarder chemical 28 has been released from the well tools 26, and after the cement 18 has set in those sections of the annulus 20 into which the retarder chemical was not released, fluid communication can be established between the interior of the casing string 16 and each of the individual zones 14*a-d*. For this purpose, each of the well tools 26 can include a valve (described more fully below).

Note that it is not necessary for a well tool that releases a retarder chemical into a wellbore to also include a valve for providing fluid communication between a casing string and a formation zone. For example, the valve could be separate from the well tool that releases the retarder chemical. Thus, it will be appreciated that the scope of this disclosure is not limited to any particular configuration, function or combination of functions of a well tool.

Referring additionally now to FIG. 1B, a lowermost (closest to a distal end 30 of the casing string 16) valve of the well tool 26 is opened. The open valve allows fracturing and other stimulation fluids (such as acid, etc.) to be flowed through the casing string 16, out through the un-set cement 18 external to the valve, and into the zone 14*a* to thereby fracture the zone.

Because the retarder chemical 28 prevented (or at least substantially delayed) setting of the cement 18 external to the well tool 26, operation of the valve was not hindered by hardened cement, and the fracturing fluids could readily flow from the well tool to the zone 14*a* and thereby exert sufficient fracturing pressure on the zone. If the retarder chemical 28 does not entirely prevent setting of the cement 18, then preferably the retarder chemical at least delays setting of the cement until the valve has been opened and fluid communication has been established between the casing string 16 and the formation 14 through the cement.

Referring additionally now to FIG. 1C, the valves of each of the other well tools 26 has been opened in succession. After opening each of the valves, fracturing fluids are flowed through the open valve into the respective one of the zones 14*b-d* to thereby fracture the zone, similar to the manner in which the zone 14*a* was fractured (see FIG. 1B). Thus, in this example, each of the zones 14*a-d* is individually fractured in succession.

Note that it is not necessary for each of multiple individual zones to be fractured in succession. For example, two or more zones could be fractured simultaneously, or a single zone could be fractured in multiple locations. Thus, the scope of this disclosure is not limited to any particular sequence of fracturing of zones, or to any number of zones fractured at a time.

Figure 2A:
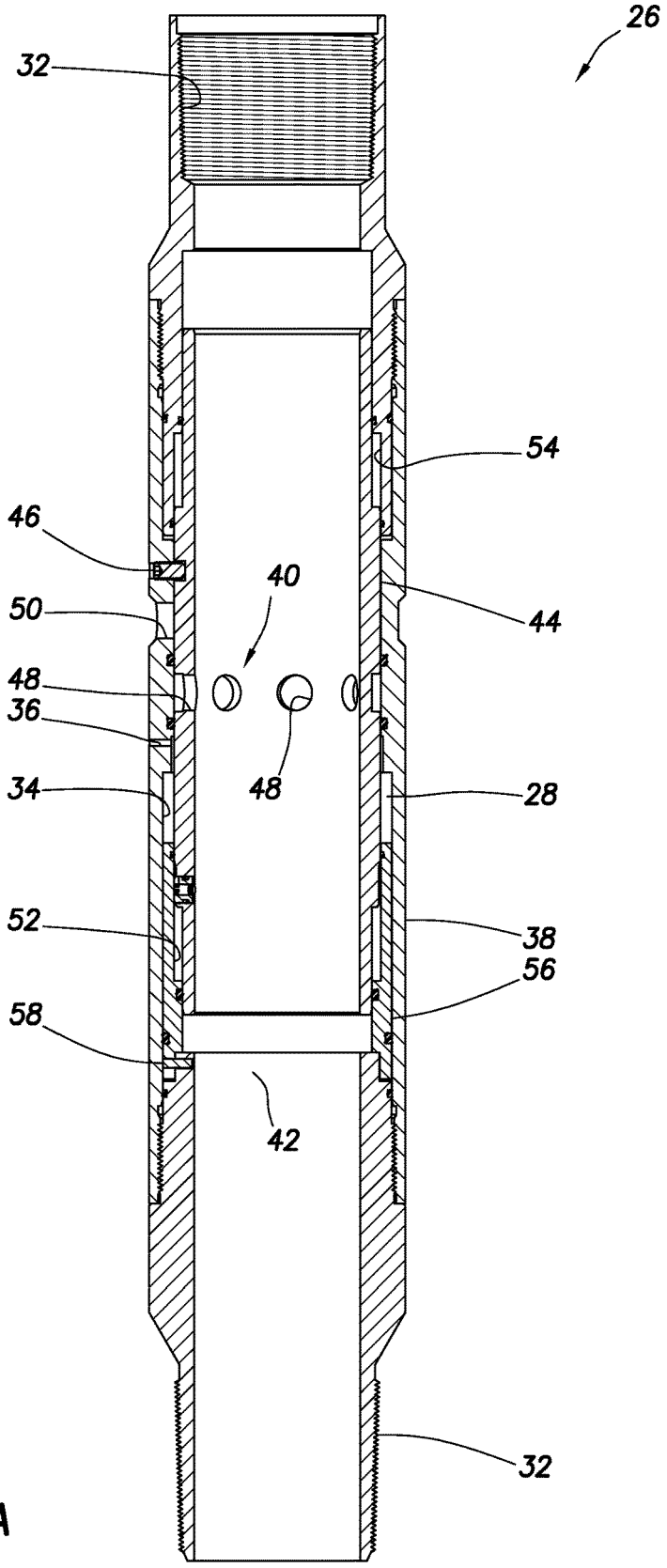
FIGS. 2A-C are enlarged scale representative cross-sectional views of an example of a well tool that may be used in the system and method of FIGS. 1A-C, the well tool being depicted in a run-in configuration, after a retarder chemical is discharged from the well tool, and after a valve of the well tool is opened.
Figure 2B:
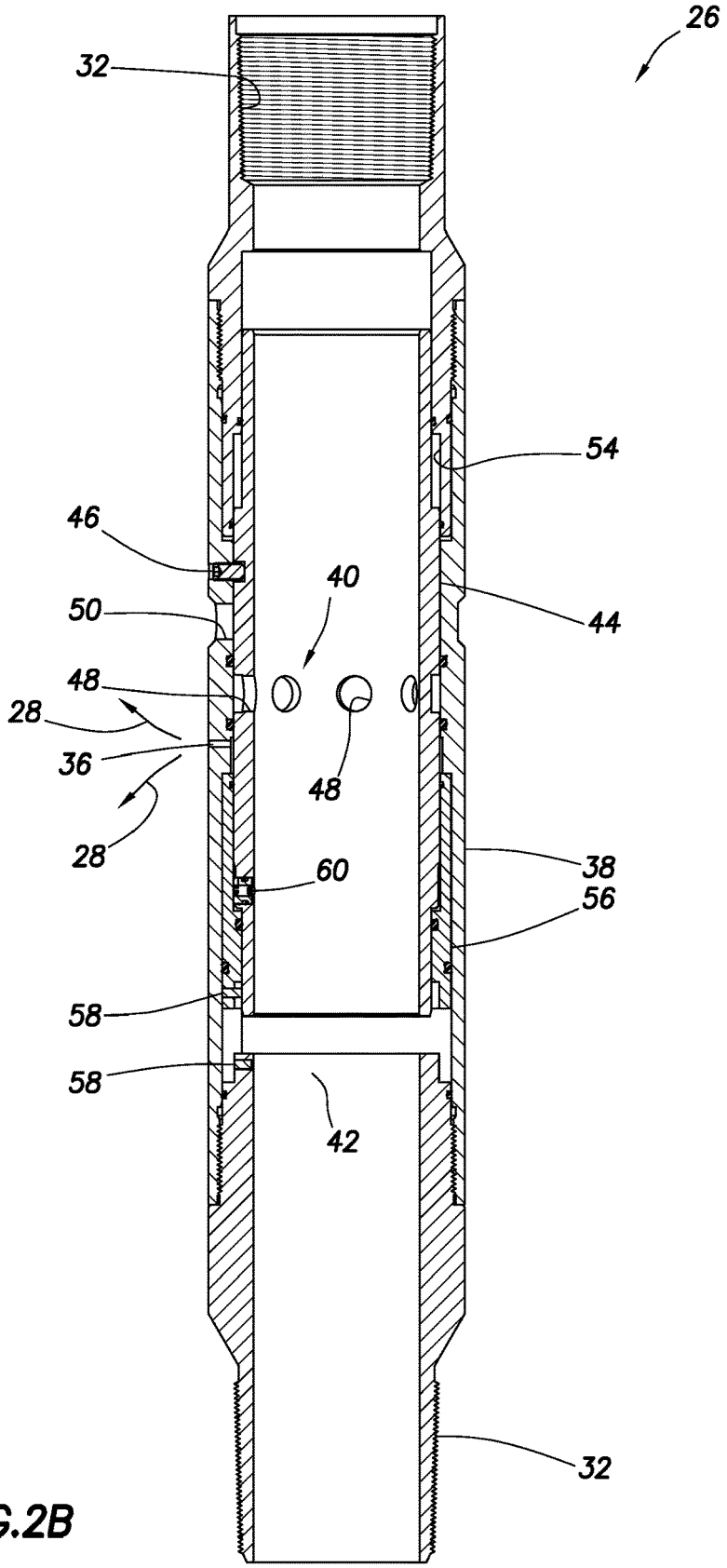
Figure 2C:
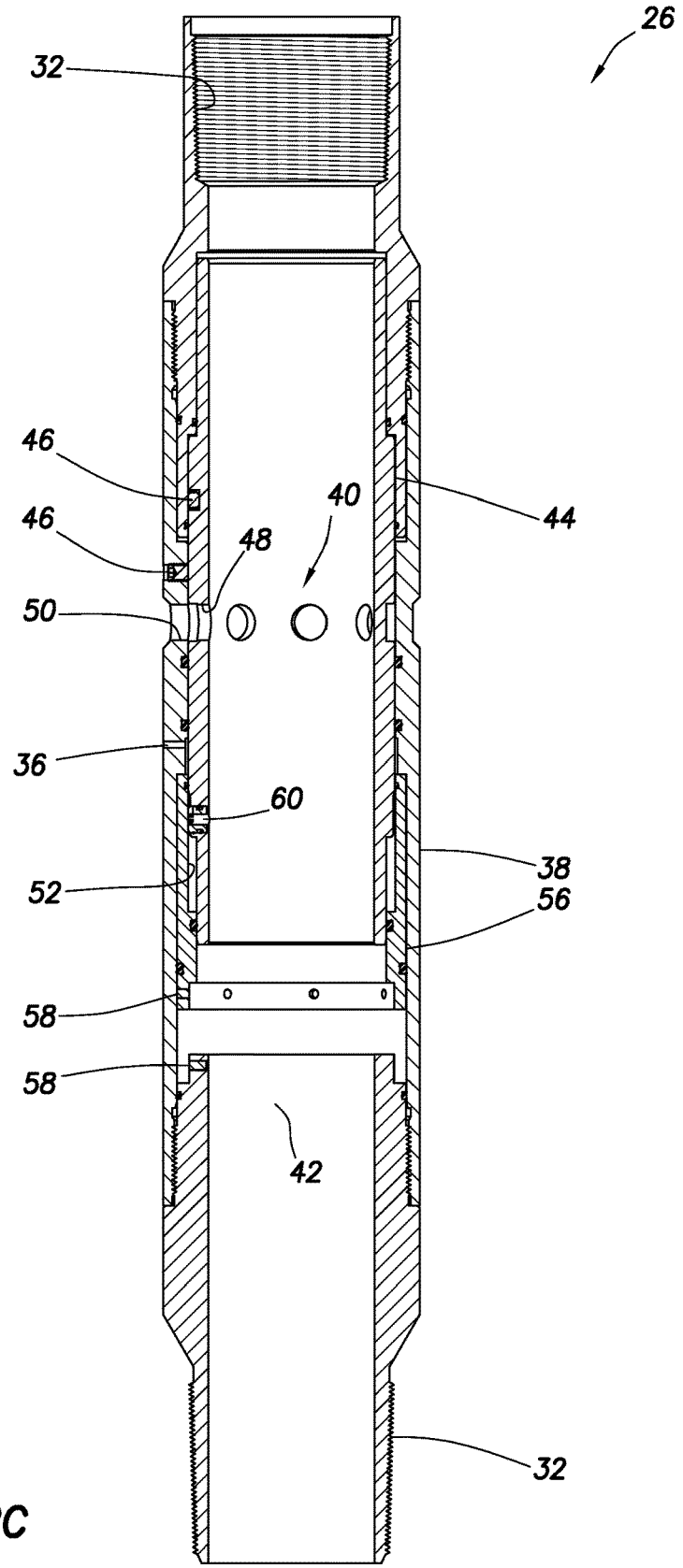

Referring additionally now to FIGS. 2A-C, an example of a well tool 26 that may be used in the FIGS. 1A-C system 10 and method is representatively illustrated. Of course, the well tool 26 of FIGS. 2A-C may be used in other systems and methods, in keeping with the scope of this disclosure.

The well tool 26 example of FIGS. 2A-C is configured for use as the lowermost well tool closest to the distal end 30 of the casing string 16 of FIGS. 1A-C. Another well tool example (such as, that depicted in FIGS. 3A-C and described more fully below) may be used for the well tools that are not lowermost in the casing string 16.

In FIG. 2A, the well tool 26 is depicted in a run-in configuration. In this configuration, the well tool 26 is connected in a casing string (such as, via threaded casing connectors 32 at opposite ends of the well tool) and deployed into a wellbore. Thus, the well tool 26 becomes a part of the casing string.

The well tool 26 contains a retarder chemical 28 in an annular internal chamber 34. The internal chamber 34 is in fluid communication with an exterior of the well tool 26 (and, thus, in communication with the annulus 20 in the FIGS. 1A-C example) via one or more discharge openings 36 formed through a generally tubular outer housing 38. In some examples, a membrane, dispersible plug (such as, comprised of grease or wax, etc.) or other type of frangible or removable barrier may be used to prevent leakage of the retarder chemical 28 from the chamber 34 to the exterior of the well tool 26 via the opening 36, until it is desired to discharge the retarder chemical from the chamber.

In the run-in configuration of FIG. 2A, the chamber 34 has a certain volume. However, the chamber 34 volume can be decreased when desired to thereby cause the retarder chemical 28 to be discharged via the opening 36.

The well tool 26 of FIGS. 2A-C also includes a valve 40. The valve 40 is used to prevent, and then selectively permit, fluid communication between the exterior of the well tool 26 and an internal flow passage 42 that extends longitudinally through the well tool. When the well tool 26 is connected in the casing string 16 and forms a part thereof, the flow passage 42 becomes part of a flow passage that extends through the casing string.

The valve 40 includes a generally tubular sleeve 44 that can slide longitudinally relative to the outer housing 38. In the run-in configuration of FIG. 2A, the sleeve 44 is retained by one or more shear members 46 in a position in which ports 48 formed radially through the sleeve are not aligned with ports 50 (only one of which is visible in FIG. 2A) formed radially through the outer housing 38. In this position, fluid communication through the valve 40 is prevented.

In the FIGS. 2A-C example, atmospheric or otherwise low pressure chambers 52, 54 cooperate with various seal surfaces of the valve 40, so that the sleeve 44 is completely or very nearly pressure balanced (that is, external pressures acting on the sleeve are "canceled out" so that the sleeve is not biased to displace by such pressures). In other examples, it may not be necessary for the sleeve 44 to be pressure balanced (e.g., the shear members 46 could be designed to resist biasing forces caused by external pressures acting on the sleeve in the run-in configuration).

An annular piston 56 disposed partially between the sleeve 44 and the outer housing 38 is not pressure balanced. Instead, external pressures acting on the piston 56 bias the piston upwardly. One or more shear members 58 prevent upward displacement of the piston 56, until a certain predetermined pressure has been applied to the piston, at which point the shear members shear and permit the piston to displace upward.

Note that, when the piston 56 displaces upward, the volume of the chamber 34 decreases. Thus, the retarder chemical 28 will be discharged from the chamber 34 when the piston 56 displaces upward.

Referring additionally now to FIG. 2B, the well tool 26 is depicted in another configuration in which the retarder chemical 28 is discharged to the exterior of the well tool. To achieve this result, a sufficient pressure has been applied to the flow passage 42 to cause the shear members 58 to shear and permit the piston 56 to displace upwardly.

The piston 56 displaces upwardly due to a pressure differential from the flow passage 42 to the chamber 52 (see FIG. 2A). This pressure differential biases the piston 56 upwardly, and displaces the piston upwardly after the shear members 58 can no longer resist the resulting biasing force.

In other examples, other pressure differentials, other ways of displacing the piston 56, and/or other means of discharging the retarder chemical 28 may be used. For example, a pressure differential from the flow passage 42 to the exterior of the well tool 26 could be used to bias a piston and discharge the retarder chemical 28. Thus, the scope of this disclosure is not limited to any particular configuration of elements of the well tool 26, or to any particular way of discharging the retarder chemical 28.

Note that, in the configuration of FIG. 2B, the sleeve 44 remains pressure balanced. The chamber 52 (see FIG. 2A) remains at a relatively low pressure, even though its volume has decreased. Even if the sleeve 44 is not substantially pressure balanced at this point, the shear members 46 continue to prevent displacement of the sleeve from its closed position.

The sleeve 44 can be displaced, however, by admitting sufficient pressure to the chamber 52 to bias the sleeve upwardly with a force great enough to shear the shear members 46. For this purpose, a rupture disc 60 is provided in the sleeve.

Referring additionally now to FIG. 2C, the well tool 26 is depicted in a configuration in which a certain predetermined pressure has been applied to the flow passage 42, thereby causing the rupture disc 60 to rupture and allow fluid communication between the flow passage and the chamber 52. This significantly unbalances the sleeve 44, so that it has been biased upward with enough force to shear the shear members 46, thereby allowing the sleeve to displace upward.

Thus, the valve 40 is in its open configuration. Fluid communication is now permitted between the flow passage 42 and the exterior of the well tool 26 via the aligned openings 48, 50.

In operation with the system 10 and method example of FIGS. 1A-C, the well tool 26 of FIGS. 2A-C is connected as the lowermost well tool in the casing string 16. Cement 18 is flowed through the casing string 16 and into the annulus 20.

In accordance with conventional practice, a wiper plug (such as a five wiper plug, not shown) follows the cement 18 through the casing string 16 and eventually lands in the float collar 24. Thus, the cement 18 is placed in the annulus 20, and a lower end of the casing string 16 is sealed off, thereby allowing pressure in the casing string to be increased above hydrostatic.

Pressure in the casing string 16 is increased after the wiper plug lands (for example, in conjunction with pressure testing of the casing string), until a first predetermined pressure at the well tool 26 is reached. At this first predetermined pressure, the shear members 58 shear and the piston 56 displaces upward, thereby discharging the retarder chemical 28 into the annulus 20.

The retarder chemical 28 prevents the cement 18 external to the well tool 26 from setting. However, the cement 18 in portions of the annulus 20 not exposed to the retarder chemical 28 is allowed to set.

After the cement 18 has set in portions of the annulus 20 not exposed to the retarder chemical 28, pressure in the casing string 16 is again increased, until a second predetermined pressure at the lowermost well tool 26 is reached. The second predetermined pressure is in this example greater than the first predetermined pressure. At the second predetermined pressure, the rupture disc 60 ruptures, the shear members 46 shear and the valve 40 opens. When the valve 40 is opened, fracturing fluids can flow through the ports 48, 50, through the unset cement 18 in the annulus 20 external to the well tool 26, and into the formation zone 14*a* to thereby fracture the zone.

Figure 3A:
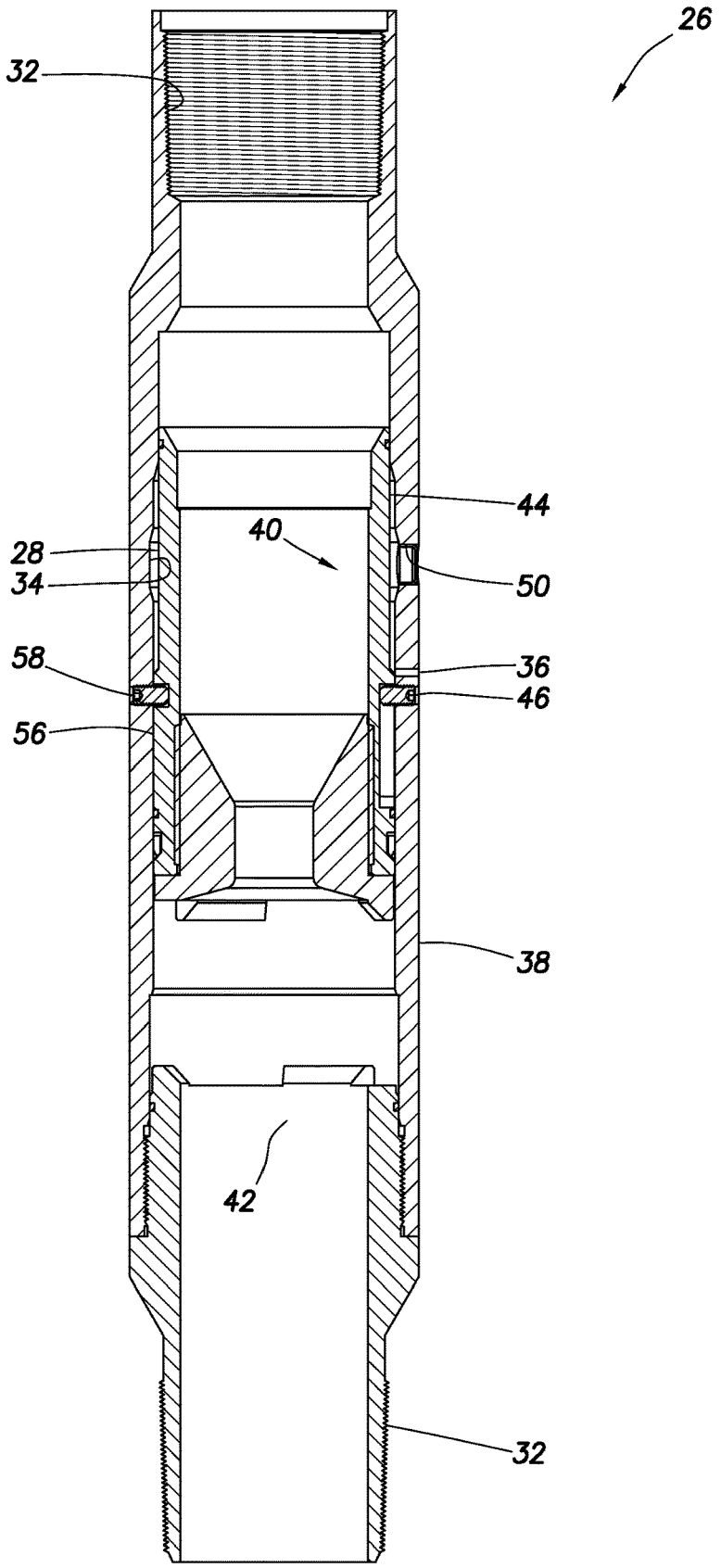
FIGS. 3A-C are enlarged scale representative cross-sectional views of another example of a well tool that may be used in the system and method of FIGS. 1A-C, the well tool being depicted in a run-in configuration, after a retarder chemical is discharged from the well tool, and after a valve of the well tool is opened.
Figure 3B:
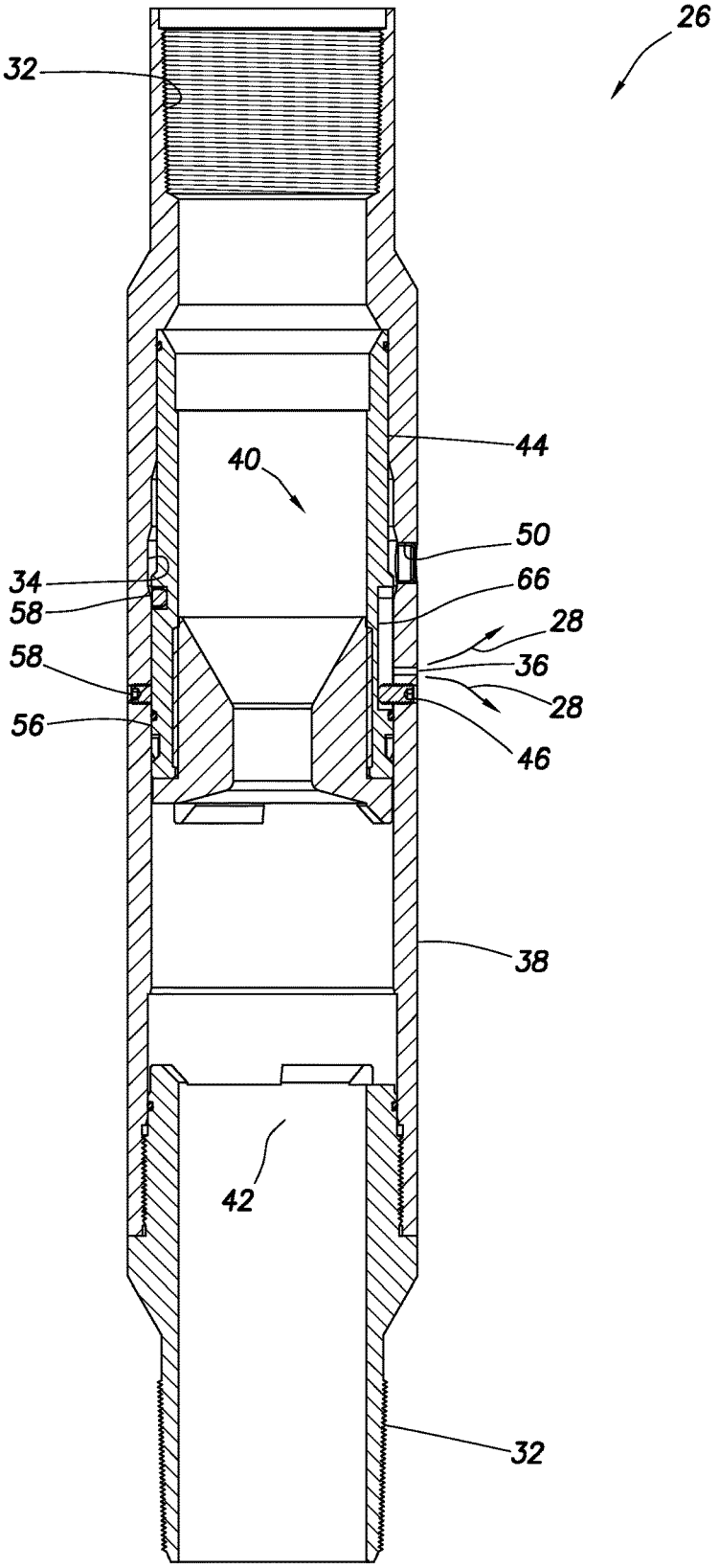
Figure 3C:
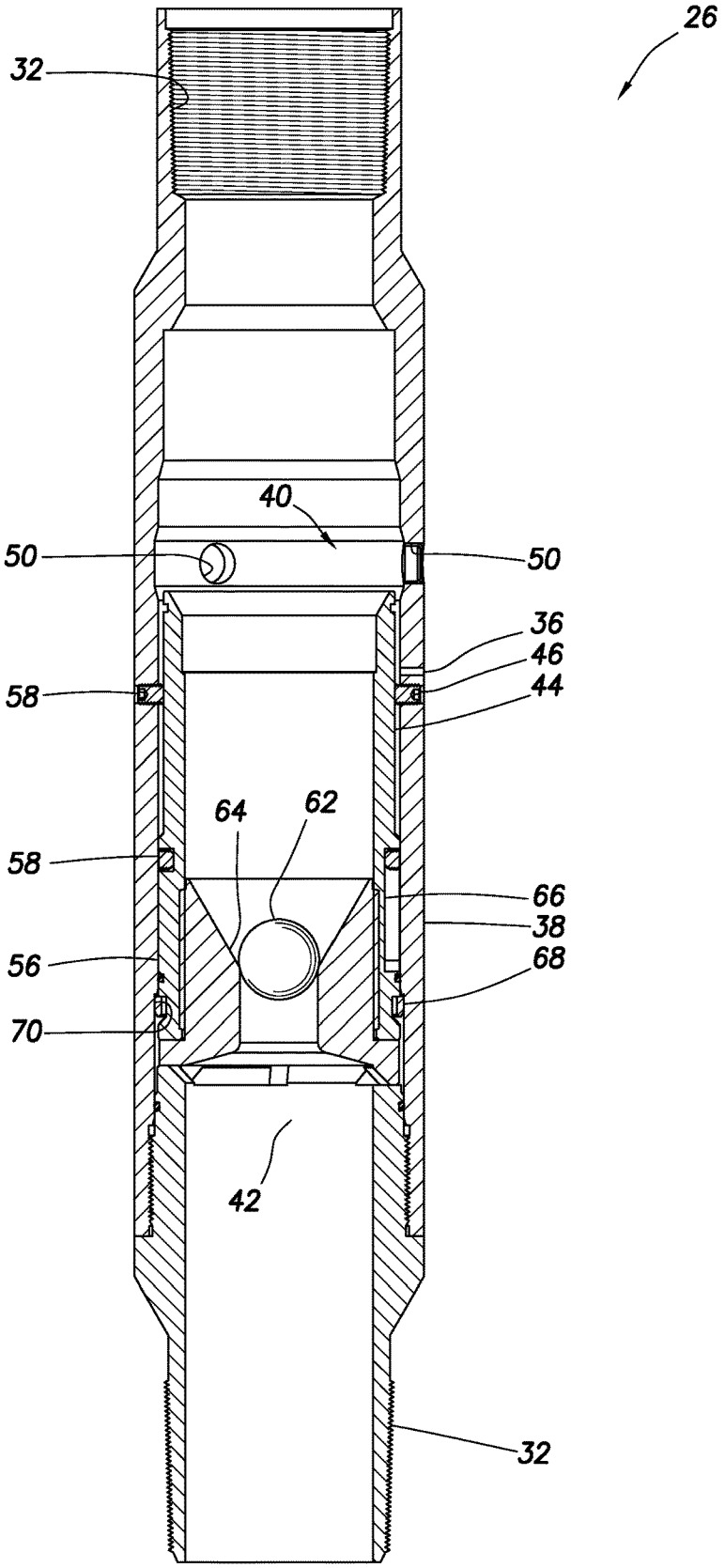

Referring additionally now to FIGS. 3A-C, another example of the well tool 26 that may be used in the FIGS. 1A-C example for the well tools not lowermost in the casing string 16. Elements of the well tool 26 of FIGS. 3A-C that are similar to, or perform a function similar to, those of the well tool of FIGS. 2A-C are indicated in FIGS. 3A-C using the same reference numbers.

In FIG. 3A, the well tool 26 is depicted in a run-in configuration, in which the well tool is connected as part of a casing string and installed in a well. In this configuration, the valve 40 prevents fluid communication between the flow passage 42 and the exterior of the well tool 26. When used in the FIGS. 1A-C example, multiple well tools 26 would be used, with each well tool positioned adjacent a respective one of the formation zones 14*b-d*.

Referring specifically to FIG. 3A, the retarder chemical 28 is contained in the chamber 34 formed between the outer housing 38 and a sleeve 44 on the piston 56. When pressure in the flow passage 42 is increased to a certain predetermined level, a resulting pressure differential (from the flow passage to the exterior of the well tool 26) biases the piston 56 upward with sufficient force to shear the shear members 58 and allow the piston to displace upward.

Referring additionally now to FIG. 3B, the well tool 26 is representatively illustrated after the shear member 58 has sheared and the piston 56 has displaced upward. The upward displacement of the piston 56 decreases a volume of the chamber 34, and thereby causes the retarder chemical 28 to be discharged via the opening 36 to the exterior of the well tool 26. The valve 40 remains closed, with the sleeve 44 blocking fluid communication via the ports 50 between the flow passage 42 and the exterior of the well tool 26.

Referring additionally now to FIG. 3C, the well tool 26 is representatively illustrated after a plug 62 has engaged a plug seat 64, and a sufficient pressure differential has been applied (e.g., by increasing pressure in the flow passage 42 above the plug) to shear the shear member 46 and allow the piston 56 and sleeve 44 to displace downward. In this configuration, the valve 40 is open and permits fluid communication between the flow passage 42 and the exterior of the well tool 26. When the piston 56 and sleeve 44 are displaced to their FIG. 3C position, a snap ring 68 carried on the piston expands radially outward and engages an annular recess 70 in the outer housing 38, thereby preventing subsequent upward displacement of the piston and sleeve.

Note that the shear member 46 was not sheared when the piston 56 displaced upward (as depicted in FIG. 3B), because the shear member 46 is received in a slot 66 formed on the piston 56. The slot 66 allows for upward displacement of the piston 56 from its FIG. 3A position to its FIG. 3B position, but does not allow the piston to displace downward to its FIG. 3C position until a sufficient pressure differential is applied across the plug 62.

The plug 62 may be sealingly engaged with the plug seat 64 by releasing it into the flow passage 42 (for example, at the earth's surface) and pumping it through the flow passage to the plug seat. Although the plug 62 is depicted as being in the form of a ball or sphere, other types of plugs may be used, if desired.

In operation with the system 10 and method example of FIGS. 1A-C, the well tool 26 of FIGS. 3A-C is used for each of the well tools other than the lowermost well tool in the casing string 16. As described above, a wiper plug (such as a five wiper plug, not shown) follows the cement 18 through the casing string 16 and eventually lands in the float collar 24. Thus, the cement 18 is placed in the annulus 20, and a lower end of the casing string 16 is sealed off, thereby allowing pressure in the casing string to be increased above hydrostatic.

Pressure in the casing string 16 is increased after the wiper plug lands (for example, in conjunction with pressure testing of the casing string), until a predetermined pressure at the well tool 26 is reached. At this predetermined pressure, the shear members 58 shear and the piston 56 displaces upward, thereby discharging the retarder chemical 28 into the annulus 20. Note that this occurs for all of the well tools 26 (both for the lowermost well tool, and for the well tools that are not lowermost in the casing string).

The retarder chemical 28 prevents the cement 18 external to the well tools 26 from setting. However, the cement 18 in portions of the annulus 20 not exposed to the retarder chemical 28 is allowed to set.

After the cement 18 has set in portions of the annulus 20 not exposed to the retarder chemical 28, pressure in the casing string 16 is again increased, until a second predetermined pressure at the well tool 26 is reached. This opens the valve 40 of the lowermost well tool 26, as described above, and the formation zone 14*a* is fractured.

After the formation zone 14*a* is fractured, a plug 62 is released into the flow passage 42, and the plug engages the plug seat of the well tool 26 corresponding to the formation zone 14*b*. Pressure in the flow passage 42 above the plug 62 is increased until a sufficient pressure differential is created across the plug to shear the shear member 46 and displace the piston 56 and sleeve 44 downward, thereby opening the valve 40 of that well tool (see FIG. 3C). Fluid communication is now permitted between the flow passage 42 and the zone 14*b*, and fracturing fluid can be flowed through the ports 50 to the zone 14*b* through the unset cement 18 exterior to the well tool 26 with sufficient pressure to fracture the zone. The plug 62 isolates the previously fractured zone 14*a* from pressures applied above the plug (such as, pressure applied to open the valve 40, pressure applied to fracture the zone 14*b*, etc.).

After the formation zone 14*b* is fractured, the steps of releasing a plug 62 into the flow passage 42, applying pressure to the flow passage above the plug and fracturing the respective zone can be repeated for each of the well tools 26 corresponding to the zones 14*c,d*. Eventually, all of the zones 14*a-d* are fractured as depicted in FIG. 1C.

Note that the plug 62 and plug seat 64 used to open the valve 40 of each successive well tool 26 corresponding to the zones 14*b-d* will have an incrementally larger size (e.g., the first plug released will have the smallest size, the next plug released will have an incrementally larger size, etc., and the last plug released will have the largest size). The plugs 62 and plug seats 64 can be drilled out after fracturing operations are completed.

Note that, in the well tool 26 examples of FIGS. 1A-3C, the retarder chemical 28 is discharged from a well tool at a location between the well tool's ports 50 and the distal end 30 of the casing string 16. This is a preferred (although not necessary) feature of the well tools 26 that takes into account a tendency of a casing string to elongate when pressure internal to the casing string is decreased. Thus, in the above examples, after the retarder chemical 28 is discharged from a well tool 26 and pressure in the casing string 16 is subsequently decreased, the retarder chemical will be positioned more directly adjacent to the ports 50, due to the casing string elongating.

Figure 4A:
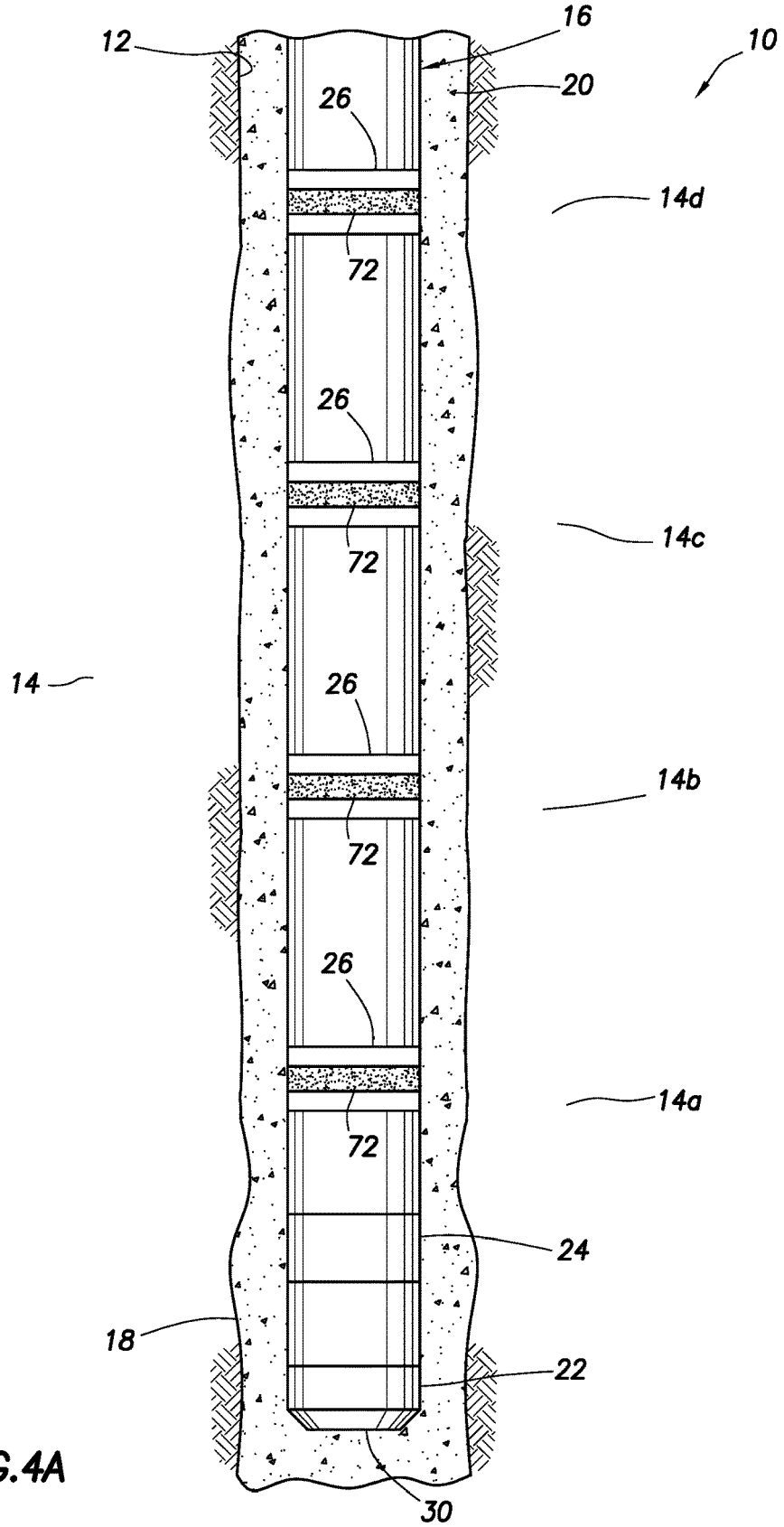
FIGS. 4A-C are representative partially cross-sectional views of another example of a well system and associated method which can embody principles of this disclosure, the well system being depicted after a casing string has been installed in a well, after a first zone has been fractured, and after multiple zones have been fractured.
Figure 4B:
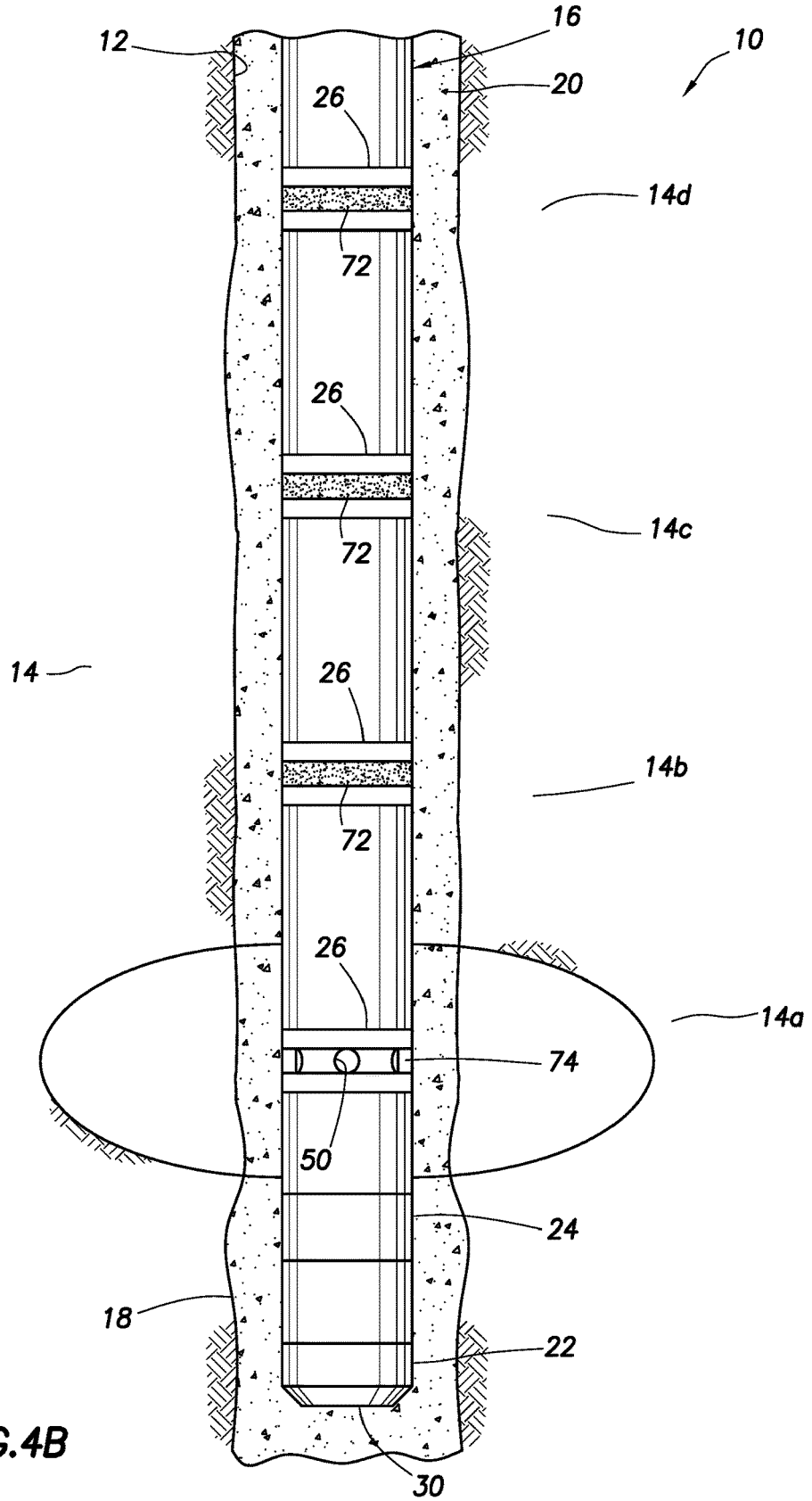
Figure 4C:
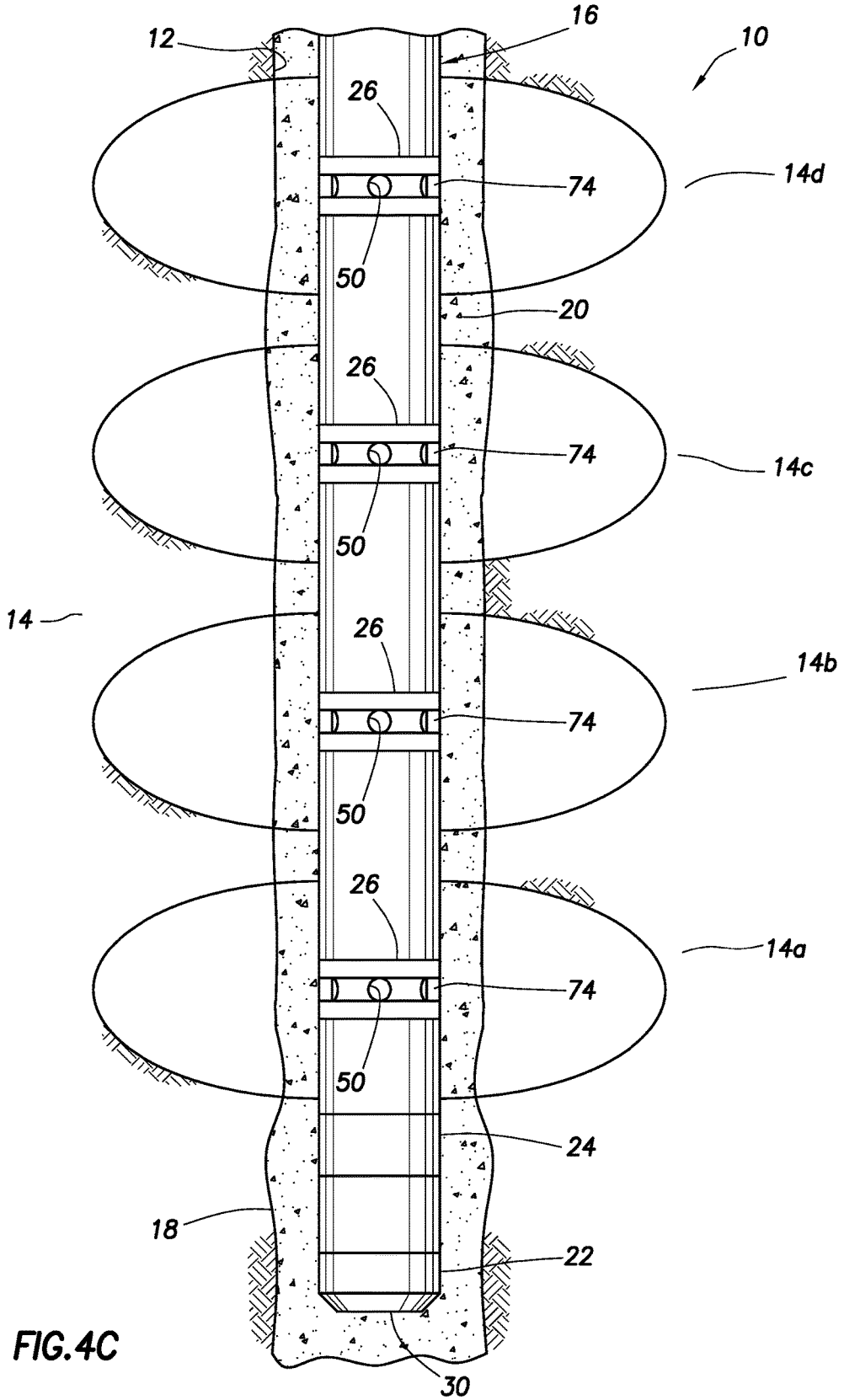

Referring additionally now to FIGS. 4A-C, another example of the system 10 is representatively illustrated. Elements of the system 10 that are similar to, or perform functions similar to, those described above are indicated in FIGS. 4A-C using the same reference numbers.

As depicted in FIGS. 4A-C, the casing string 16 is installed in the wellbore 12 and cement 18 is placed in the annulus 20. Multiple well tools 26 are connected in the casing string 16 adjacent respective formation zones 14*a-d*.

Referring specifically to FIG. 4A, it may be seen that each of the well tools 26 includes an exterior component 72 exposed to, and contacted by, the cement 18. In some examples, the exterior component 72 can include the retarder chemical 28, so that the retarder chemical is released from the exterior component, in order to prevent (or at least retard) setting of the cement 18 at each of the well tools 26.

In some examples, the exterior component 72 can be dissolvable, frangible or otherwise dispersible to thereby provide for a lack of cement 18 adjacent the ports 50 of the valve 40. This void or lack of cement 18 can prevent the cement from hindering operation of the valve 40, and can provide for enhanced fluid communication in fracturing operations.

Referring additionally now to FIG. 4B, the exterior component 72 corresponding to the lowermost well tool 26 has dissolved or otherwise dispersed, so that a void 74 or lack of cement 18 now exists about the ports 50. The valve 40 of the lowermost well tool 26 is opened, and the void 74 provides for enhanced fluid communication between the interior of the casing string 16 and the zone 14*a*. Thus, the zone 14*a* can be readily fractured.

Note that it is not necessary for the component 72 to be dispersed prior to opening of the valve 40 or fracturing of the zone 14*a*. In some examples, the component 72 could remain in place on the well tool 26 while the valve 40 is opened, and the component could be dispersed after or when the valve is opened (for example, the component could be frangible so that it is broken when fracturing fluid is pumped outward through the ports 50, or the component could be dissolved by flowing a suitable acid, solvent or other dissolving fluid through the open valve 40).

Referring additionally now to FIG. 4C, the valves 40 of the well tools 26 not lowermost in the casing string 16 have been opened, the exterior components 72 have been dispersed, and the formation zones 14*b-d* have been fractured in succession. A void 74 or lack of cement 18 is formed external to each set of valve ports 50.

Figure 5:
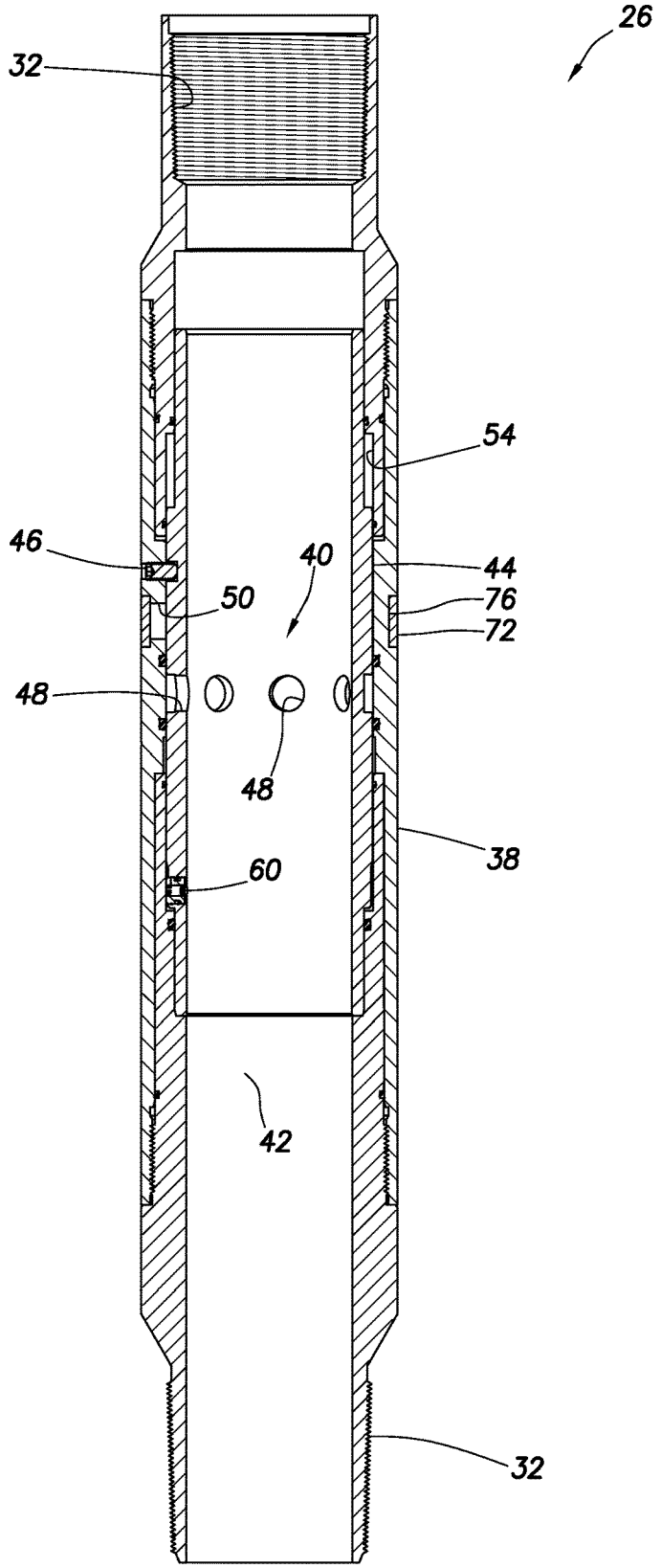
FIG. 5 is an enlarged scale representative cross-sectional view of an example of a well tool that may be used in the system and method of FIGS. 4A-C.

Referring additionally now to FIG. 5, an example of a well tool 26 that may be used for the lowermost well tool in the FIGS. 4A-C example is representatively illustrated. The FIG. 5 well tool 26 is similar in many respects to that of FIGS. 2A-C, and so elements that are similar or perform similar functions are indicated in FIG. 5 using the same reference numbers.

One difference between the FIG. 5 example and the FIGS. 2A-C example is that the FIG. 5 example does not include the chamber 34 for containing the retarder chemical 28, the opening 36 for discharging the retarder chemical, or the piston 56 for forcing the retarder chemical from the chamber. However, these elements could be provided in the FIG. 5 example, if desired.

Similarly, the exterior component 72 of the FIG. 5 example could be provided in the example of FIGS. 2A-C. In the FIG. 5 example, the component 72 is received in an annular recess 76 formed on an exterior of the outer housing 38. In this example, the component 72 completely overlies the ports 50.

Operation of the FIG. 5 example is similar to that described above for the FIGS. 2A-C example, except that an application of pressure to the flow passage 42 is not used to discharge the retarder chemical 28 from the well tool 26. Instead, the cement 18 in the annulus 20 is allowed to set, and then the valve 40 is opened by applying pressure to the flow passage 42 to thereby cause the rupture disc 60 to rupture. When the rupture disc 60 ruptures, the shear member 46 shears and the sleeve 44 displaces upward, thereby opening the valve 40.

In one example, the component 72 can dissolve or otherwise disperse due to contact with the cement 18, leaving the void 74 external to the ports 50. In this manner, operation of the valve 40 is not hindered by presence of the cement 18, and fluid communication between the ports 50 and the formation 14 through the remaining cement is enhanced.

In this example, the component 72 could comprise a material such as poly-lactic acid (PLA) or poly-glycolic acid (PGA) that dissolves over time as the cement 18 sets. The component 72 could comprise a material (such as magnesium) that disperses by galvanic reaction over time as the cement 18 sets. The scope of this disclosure is not limited to use of any particular material in the component 72.

In another example, the component 72 can include the retarder chemical 28 therein, so that the retarder chemical is released from the component and prevents (or at least retards) setting of the cement 18 adjacent the well tool 26. In this manner, a void would not necessarily be formed external to the ports 50, but the unset cement 18 adjacent the well tool 26 would not hinder operation of the valve 40 or prevent fluid communication between the flow passage 42 and the formation 14.

The retarder chemical 28 could leach from the component 72 over time as the cement 18 sets in other portions of the annulus 20. For example, the component 72 could comprise an open cell foam material, with the retarder chemical 28 disposed in pores of the foam material. As another example, the component 72 could comprise a container for the retarder chemical 28, with the container or a barrier associated with the container being made of a material that is dissolvable, frangible or otherwise dispersible to thereby release the retarder chemical from the container.

As depicted in FIG. 5, the component 72 is annular-shaped and is positioned completely external to the ports 50. In other examples, the component 72 could extend into the ports 50 and/or the component could be otherwise shaped. In examples in which the retarder chemical 28 is released from the component 72 prior to release of a pressure applied in the casing string 16, it may be beneficial to position the component between the ports 50 and the distal end 30 of the casing string (e.g., below the ports 50 as viewed in FIG. 5), so that when the casing string elongates upon release of the applied pressure, the ports will be positioned adjacent the released retarder chemical.

Figure 6:
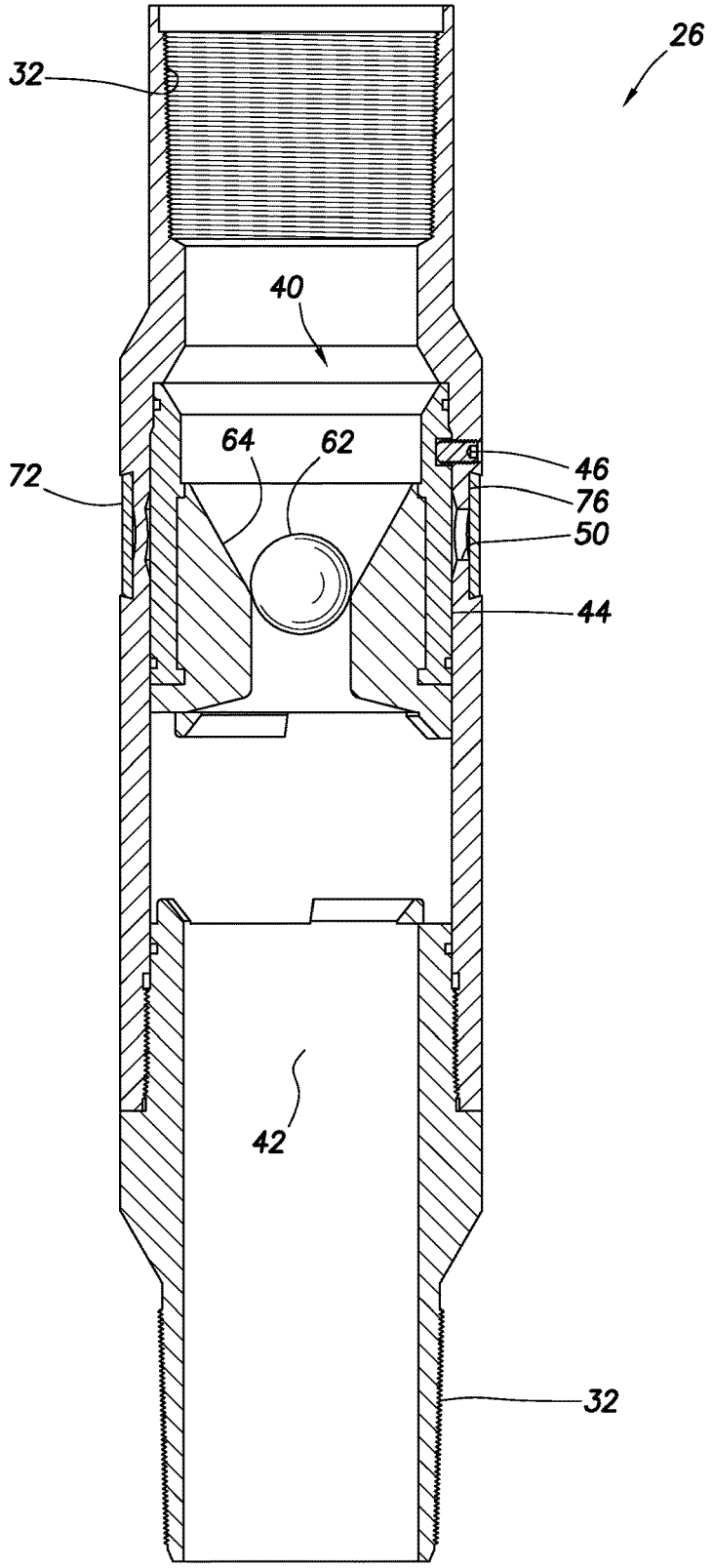
FIG. 6 is an enlarged scale representative cross-sectional view of another example of a well tool that may be used in the system and method of FIGS. 4A-C.

Referring additionally now to FIG. 6, another example of the well tool 26 that may be used with the FIGS. 4A-C system 10 and method example is representatively illustrated. The FIG. 6 well tool 26 may be used for the well tools that are not lowermost in the casing string 16.

The FIG. 6 well tool 26 is similar in many respects to the example of FIGS. 3A-C, and so elements that are similar, or perform similar functions, are indicated in FIG. 6 using the same reference numbers. One difference between the FIG. 6 and the FIGS. 3A-C examples is that the FIG. 6 example does not include the retarder chemical 28 in the chamber 34, the shear member 58, the discharge opening 36 or the piston 56 for forcing the retarder chemical out of the chamber. However, these elements could be provided in the FIG. 6 example, if desired. Similarly, the FIGS. 3A-C well tool example could be provided with the exterior component 72 of the FIG. 6 example.

Operation of the FIG. 6 example is similar to that described above for the FIGS. 3A-C example, except that an application of pressure to the flow passage 42 is not used to discharge the retarder chemical 28 from the well tool 26. Instead, the cement 18 in the annulus 20 is allowed to set, and then the valve 40 is opened by releasing the plug 62 into the flow passage 42 and applying pressure to the flow passage above the plug, thereby causing the shear member 46 to shear. When the shear member 46 shears, the sleeve 44 displaces downward, thereby opening the valve 40.

The exterior component 72 of the FIG. 6 example may be the same as or similar to that of the FIG. 5 example described above, and may be configured and/or positioned on the FIG. 6 example in a similar manner. The FIG. 6 component 72 may be dissolvable, frangible or otherwise dispersible, and/or may include the retarder chemical 28 therein. The retarder chemical 28 may leach from the component 72, or the retarder chemical may be released by opening of a container of the component (such as, by dissolving or breaking the container or another barrier, etc.).

In operation with the system 10 and method example of FIGS. 4A-C, the well tool 26 of FIG. 6 is used for each of the well tools other than the one closest to the distal end 30 of the casing string 16. As described above, a wiper plug (such as a five wiper plug, not shown) follows the cement 18 through the casing string 16 and eventually lands in the float collar 24. Thus, the cement 18 is placed in the annulus 20, and a lower end of the casing string 16 is sealed off, thereby allowing pressure in the casing string to be increased above hydrostatic.

If the retarder chemical 28 is released from the component 72 of the FIGS. 5 & 6 well tools 26, the retarder chemical prevents the cement 18 external to the well tools 26 from setting (or substantially retards such setting). However, the cement 18 in portions of the annulus 20 not exposed to the retarder chemical 28 is allowed to set.

After the cement 18 has set in portions of the annulus 20 not exposed to the retarder chemical 28 (if any), pressure in the casing string 16 is increased, until a predetermined pressure is reached. This opens the valve 40 of the lowermost well tool 26, as described above, and the formation zone 14*a* is fractured. If the component 72 remains on the lowermost well tool 26 when the valve 40 is opened, the fluid(s) flowed through the ports 50 may cause the component to dissolve, break or otherwise disperse.

After the formation zone 14*a* is fractured, a plug 62 is released into the flow passage 42, and the plug engages the plug seat of the well tool 26 corresponding to the formation zone 14*b*. Pressure in the flow passage 42 above the plug 62 is increased until a sufficient pressure differential is created across the plug to shear the shear member 58 and displace the sleeve 44 downward, thereby opening the valve 40.

Fluid communication is now permitted between the flow passage 42 and the exterior of the well tool 26, and fracturing fluid can be flowed through the ports 50 to the zone 14*b* through the cement 18 exterior to the well tool 26 with sufficient pressure to fracture the zone. If the component 72 remains on the well tool 26 when the valve 40 is opened, the fluid(s) flowed through the ports 50 may cause the component to dissolve, break or otherwise disperse.

If the retarder chemical 28 was released from the component 72, unset cement 18 external to the well tool 26 provides for direct fluid communication and application of fracturing pressure to the zone 14*b*. If the component 72 is dispersed, then the resulting void 74 external to the ports 50 provides for ready communication of fluid pressure to the cement 18 external to the well tool 26 and, if the cement is set, the cement can be readily broken down by such pressure to thereby provide direct fluid communication to the zone 14*b*. Note that, in some examples, the retarder chemical 28 may be released from the component 72, and the component may be dispersed.

After the formation zone 14*b* is fractured, the steps of releasing a plug 62 into the flow passage 42, applying pressure to the flow passage above the plug and fracturing the respective zone can be repeated for each of the well tools 26 corresponding to the zones 14*c,d*. Eventually, all of the zones 14*a-d* are fractured as depicted in FIG. 4C. Note that the plug 62 and plug seat 64 used to open the valve 40 of each successive well tool 26 will have an incrementally larger size (e.g., the first plug released will have the smallest size, the next plug released will have an incrementally larger size, etc., and the last plug released will have the largest size). The plugs 62 and plug seats 64 can subsequently be drilled out.

If the component 72 in the FIGS. 4A-6 examples disperses and the voids 74 are thereby formed, and if the voids extend completely about the well tools 26, then an advantage is obtained in that a plane of minimum principal stress in the formation 14 will necessarily intersect the voids. Since the voids 74 provide for enhanced application of fluid pressure to the cement 18 external to the well tools 26, and to the formation zones 14*a-d* external to the cement, the voids will also provide for enhanced application of fluid pressure to a plane of minimum principal stress at each zone, thereby reducing a pressure that would otherwise need to be applied in order to produce a fracture in the zone.

It may now be fully appreciated that the above disclosure provides significant advancements to the art of providing fluid communication with an earth formation through cement. In some examples described above, a well tool 26 can include a retarder chemical 28 that prevents (or at least retards) setting of cement 18 external to the well tool. In other examples described above, a well tool 26 can include a component 72 that releases the retarder chemical 28 and/or disperses to thereby form a void 74 and provide for enhanced communication with the formation 14.

The above disclosure provides to the art a system 10 for use with a well. In one example, the system 10 can comprise a well tool 26 including a retarder chemical 28, and casing connectors 32 at opposite ends of the well tool. The retarder chemical 28 is released from the well tool 26 into an annulus 20 surrounding the well tool and retards setting of a cement 18 in the annulus.

The retarder chemical 28 may be released from an internal chamber 34 of the well tool 26.

The retarder chemical 28 may be released from an exterior of the well tool 26.

The retarder chemical 28 may be released from an exterior component 72 of the well tool 26, the exterior component being exposed to the cement 18. The exterior component 72 may dissolve in response to exposure to the cement 18.

The exterior component 72 may be annular-shaped. The retarder chemical 28 may leach from the exterior component 72.

The retarder chemical 28 may be released in response to application of pressure to an interior of the well tool 26.

The well tool 26 can include a valve 40 that selectively prevents and permits fluid communication between the annulus 20 and an interior flow passage 42 that extends longitudinally through the well tool 26. The retarder chemical 28 may be released in response to application of a first pressure to the interior flow passage 42, and the valve 40 may be opened in response to application of a second pressure to the interior flow passage 42, with the second pressure being greater than the first pressure.

The retarder chemical 28 may be released in response to application of a predetermined pressure to the interior flow passage 42. The valve 40 may be opened in response to placement of a plug 62 in the interior flow passage 42 and application of a predetermined pressure differential across the plug.

A method of retarding setting of a cement 18 at one or more discrete locations in a well annulus 20 is also provided to the art by the above disclosure. In one example, the method comprises releasing a retarder chemical 28 from at least one well tool 26 connected in a casing string 16. The releasing step is performed after the cement 18 is placed in the annulus 20.

The releasing step can include releasing the retarder chemical 28 into the annulus 20 only proximate the at least one well tool 26.

The releasing step can include releasing the retarder chemical 28 from an internal chamber 34 of the well tool 26.

The releasing step can include releasing the retarder chemical 28 in response to application of pressure to the well tool 26.

The releasing step can include releasing the retarder chemical 28 from an exterior component 72 of the well tool 26. The releasing step can include the retarder chemical 28 leaching from the exterior component 72. The releasing step can include the exterior component 72 dissolving.

The releasing step can be performed after flowing of the cement 18 into the annulus 20 is ceased.

The method can also include opening a valve 40, thereby permitting fluid communication between the annulus 20 and an interior flow passage 42 extending through the well tool 42. The opening step can be performed after the releasing step.

The releasing step can include releasing the retarder chemical 28 into the annulus 20 at a position between a distal end 30 of the casing string 16 and a port 50 of the valve 40.

A well tool 26 is also described above. In one example, the well tool 26 can comprise a valve 40 that selectively prevents and permits fluid communication via a port 50 between an exterior of the well tool 26 and an interior flow passage 42 extending longitudinally through the well tool, an annular recess 76, and an annular dispersible exterior component 72 received in the annular recess 76.

The exterior component 72 may be dissolvable in response to contact with a fluid (such as the cement 18). The exterior component 72 may be positioned external to the port 50.

The exterior component 72 may include a retarder chemical 28. The retarder chemical 28 may leach from the exterior component 72.

The valve 40 may open in response to application of a predetermined pressure to the interior flow passage 42.

The valve 40 may open in response to application of a predetermined pressure differential across a plug 62 placed in the interior flow passage 42.

Also described above is another well tool 26 example that can include a valve 40 that selectively prevents and permits fluid communication between an exterior of the well tool 26 and an interior flow passage 42 extending longitudinally through the well tool, an internal chamber 34, and a retarder chemical 28 disposed in the internal chamber 34.

The well tool 26 can also include a discharge opening 36. The retarder chemical 28 may be discharged to an exterior of the well tool 26 via the discharge opening 36.

The retarder chemical 28 may be discharged from the well tool 26 in response to a first predetermined pressure applied to the interior flow passage 42. The valve 40 may be opened in response to a second predetermined pressure applied to the interior flow passage 42, the second pressure being greater than the first pressure.

The valve 40 may be opened in response to a predetermined pressure differential applied across a plug 62 placed in the interior flow passage 42.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A well system, comprising:

a well tool including a piston, an internal chamber, and casing connectors at opposite ends of the well tool; and a retarder chemical in the internal chamber, wherein the retarder chemical is discharged from the internal chamber into an annulus surrounding the well tool in response to a decrease in a volume of the internal chamber due to displacement of the piston, and wherein the retarder chemical retards setting of a cement in the annulus.

2. A well system, comprising:

a well tool including a longitudinal flow passage, an internal chamber formed between the flow passage and an exterior of the well tool, and casing connectors at opposite ends of the well tool; and a retarder chemical, wherein the retarder chemical is released from the internal chamber into an annulus surrounding the well tool in response to application of pressure via the flow passage, and wherein the retarder chemical retards setting of a cement in the annulus.

3. A well system, comprising:

a well tool including a retarder chemical, and casing connectors at opposite ends of the well tool; and the retarder chemical is released from the well tool into an annulus surrounding the well tool and retards setting of a cement in the annulus, wherein the well tool further comprises a valve that selectively prevents and permits fluid communication between the annulus and an interior flow passage that extends longitudinally through the well tool, wherein the retarder chemical is released in response to application of a first pressure to the interior flow passage, wherein the valve is opened in response to application of a second pressure to the interior flow passage, and wherein the second pressure is greater than the first pressure.

4. A well system, comprising:

a well tool including a retarder chemical, and casing connectors at opposite ends of the well tool; and the retarder chemical is released from the well tool into an annulus surrounding the well tool and retards setting of a cement in the annulus, wherein the well tool further comprises a valve that selectively prevents and permits fluid communication between the annulus and an interior flow passage that extends longitudinally through the well tool, wherein the retarder chemical is released in response to application of a predetermined pressure to the interior flow passage, and wherein the valve is opened in response to placement of a plug in the interior flow passage and application of a predetermined pressure differential across the plug.

5. A method of retarding setting of a cement at one or more discrete locations in a well annulus, the method comprising:

interconnecting a well tool in a casing string, the well tool including a piston, an internal chamber, and casing connectors at opposite ends of the well tool;

placing a retarder chemical in the internal chamber; and displacing the piston, thereby decreasing a volume of the internal chamber and discharging the retarder chemical from the internal chamber into the annulus, and thereby retarding the setting of the cement in the annulus.

6. A method of retarding setting of a cement at one or more discrete locations in a well annulus, the method comprising:

interconnecting a well tool in a casing string, the well tool including a longitudinal flow passage, an internal chamber formed between the flow passage and an exterior of the well tool, and casing connectors at opposite ends of the well tool; and releasing a retarder chemical from the internal chamber in response to application of pressure via the flow passage, thereby retarding the setting of the cement in the annulus.

7. A well tool, comprising:

a valve that selectively prevents and permits fluid communication between an exterior of the well tool and an interior flow passage extending longitudinally through the well tool;

an internal chamber; and a retarder chemical disposed in the internal chamber, wherein the retarder chemical is discharged from the well tool in response to a first predetermined pressure applied to the interior flow passage.

8. The well tool of claim 7, further comprising a discharge opening, and wherein the retarder chemical is discharged to the exterior of the well tool via the discharge opening.

9. The well tool of claim 7, wherein the valve is opened in response to a second predetermined pressure applied to the interior flow passage, the second pressure being greater than the first pressure.

10. The well tool of claim 7, wherein the valve is opened in response to a predetermined pressure differential applied across a plug placed in the interior flow passage.

11. The well tool of claim 7, wherein the retarder chemical retards setting of cement.

* * * * *